United States Patent [19]

Krueger et al.

[11] 4,154,033

[45] May 15, 1979

[54] TWO-PART GLAZING SYSTEM

[75] Inventors: Neil Krueger, Stillwater; Donald L. Garofalo, Saint Paul; John O. Kohl, Bayport, all of Minn.

[73] Assignee: Andersen Corporation, Bayport, Minn.

[21] Appl. No.: 918,281

[22] Filed: Jun. 22, 1978

[51] Int. Cl.[2] ..... E06B 7/14

[52] U.S. Cl. ..... 52/209; 52/476; 52/402; 52/772; 52/773; 52/778

[58] Field of Search ..... 52/209, 476, 397–403, 52/772, 773, 778; 49/408, 501

[56] References Cited

U.S. PATENT DOCUMENTS

| | | | |
|---|---|---|---|
| 1,752,605 | 4/1930 | McHugh | 52/209 |
| 2,901,786 | 9/1959 | Batts | 52/773 |
| 2,905,983 | 9/1959 | Ritz | 52/398 |
| 3,196,998 | 7/1965 | Owen | 52/397 |
| 3,566,542 | 3/1971 | Gillen et al. | 52/400 |
| 3,579,939 | 5/1971 | Eichman | 52/397 |
| 3,982,371 | 9/1976 | Preu | 52/773 |

FOREIGN PATENT DOCUMENTS

| | | | |
|---|---|---|---|
| 739428 | 10/1955 | United Kingdom | 52/788 |

*Primary Examiner*—James L. Ridgill, Jr.
*Attorney, Agent, or Firm*—Merchant, Gould, Smith, Edell, Welter & Schmidt

[57] ABSTRACT

A two-part glazing system for use on the lower rails of the upper and lower sashes of a double-hung window. The glazing system comprises a moisture impervious liner member which is snap fit onto the lower rail and underlies the lower edge of the windowpane. A glazing bead is snap fit onto the liner member and extends therefrom to the face of the windowpane. The glazing bead has a gasket for sealing against the windowpane and defining an enclosed drain tank. The gasket prevents substantial amounts of water from reaching the drain tank. Any moisture which does reach the drain tank is drained away through outlet holes in the liner member.

11 Claims, 7 Drawing Figures

TWO-PART GLAZING SYSTEM

BACKGROUND OF THE INVENTION

1. Field of the Invention

This invention relates in general to double-hung windows. More particularly, this invention relates to the movable upper and lower sash members of such a window.

2. Description of the Prior Art

Double-hung windows are well-known. Such windows normally comprise an upper and lower sash member. Each sash member is usually vertically movable in a vertical channel provided in the window frame. Each sash member customarily comprises four interrelated pieces. These pieces include two vertically extending stiles which are connected at either end to a horizontally extending rail to define a rectangular sash frame. The sash frame of each sash member is designed to mount at least one transparent windowpane which is made usually of glass.

One specific double-hung window known previously is that which is known as the Norroline® Window, which is manufactured by Andersen Corporation of Bayport, Minn. In the manufacture of the Narroline® window, a glazing bead has usually been applied along each side of the window sash to cover the exterior joint between the windowpane and the sash members which comprise the sash frame. The single exception has been that no glazing bead is usually applied to the upper rail of the lower sash which is generally known as the lower check rail. Instead, the groove in the lower check rail has usually been glazed in accordance with the teachings of U.S. Pat. No. 3,566,542. In any event, the glazing bead as used in the Narroline® window comprises a rigid vinyl snap in bead. This bead covers the joint between the windowpane and the sash frame. This not only protects the joint from the deleterious effects of weather, but also decoratively enhances the appearance of the window.

While the glazing bead as used in the Narroline® window has functioned suitably in most respects, this bead has a generally curved or half-concaved portion which is adjacent to and underlies the side of the windowpane. This particular cross-sectional configuration has caused certain difficulties. One problem encountered has been that precipitation from a rain or snow storm often collects on the face of the windowpane. This precipitation flows, by gravity, down the face of the windowpane towards the lower rail of the sash. When this precipitation encounters the glazing bead, the water is often directed by the curved shape of the bead between the bead and the side of the glass pane. Once so directed, the water is trapped beneath the glazing bead on top of the lower sash rail. This water, if let standing a sufficient length of time, can be very deleterious to the sash rail which is made of wood. In fact, such water hastens physical deterioration of the wood and fosters rotting of the sash rail.

To the best of Applicants' knowledge, no prior double-hung windows having wooden sashes have ever been provided with a system for minimizing the problem of standing water on the lower sash rails. Certain aluminum windows have been provided with drain holes at the bottom of the lower window member for draining water therefrom. However, such drain holes have not been incorporated into wooden sash windows and are not generally suitable for use in such windows.

This is so because such drain holes are time-consuming and difficult to drill or otherwise machine in a wooden sash rail. The added labor caused by such an operation increases the expense of the window.

SUMMARY OF THE INVENTION

One aspect of this invention is the provision of a glazing system for a double-hung window which provides for the improved handling and draining of moisture collecting on the face of the windowpane.

This invention relates to an improved window sash of the type having two vertically extending stiles connected at one end by an upper rail and at the other end by a lower rail. Both the stiles and the rails have a generally solid cross-sectional configuration (i.e. are solid wooden members). This configuration includes a first surface against which the windowpane abuts and a second surface extending outwardly from the first surface. The second surface is located adjacent to and extends along one side of the windowpane. This invention comprises a two-part glazing system for use on at least the lower rail of the window sash. The glazing system comprises a moisture impervious liner member which is attached to the second surface of the lower rail and which extends along substantially the entire length of the lower rail. The liner member has a glazing bead operatively associated therewith. The glazing bead extends between the liner member and the face of the windowpane to define a substantially enclosed drain tank. The glazing bead has a flexible gasket means which seals against the face of the windowpane to minimize the amount of water which is able to get into the drain tank. However, the liner member has a plurality of outlet port means for draining away to the exterior of the window sash any water which does, in fact, reach the drain tank.

BRIEF DESCRIPTION OF THE DRAWINGS

This invention will be described hereafter in the following Detailed Description, when taken in conjunction with the following figures, in which like numerals will refer to like elements throughout the several views.

DETAILED DESCRIPTION

Figure 1:
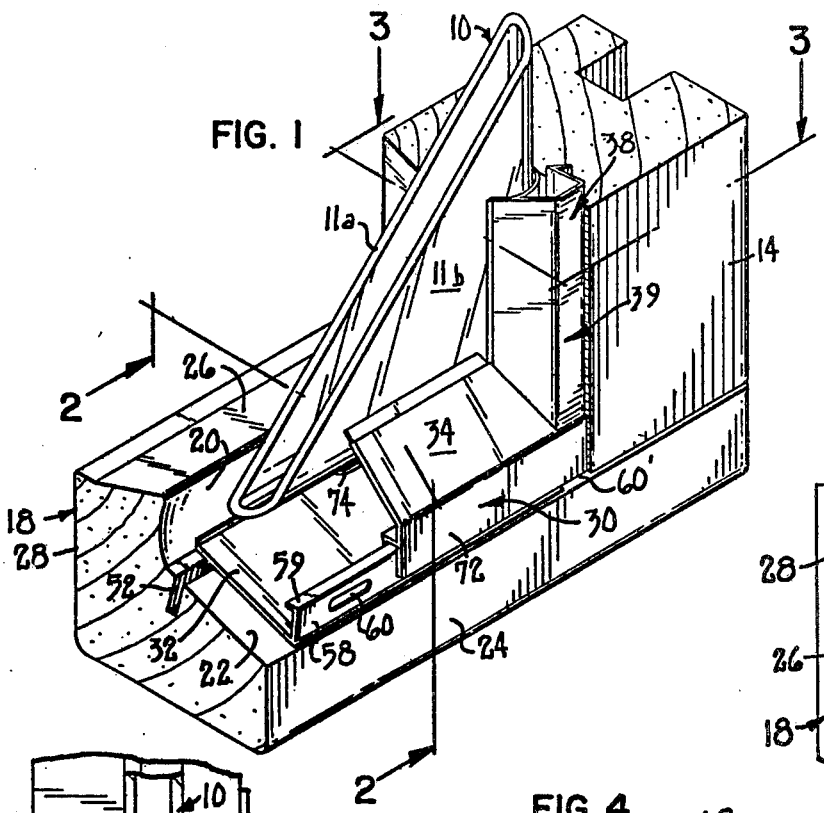
FIG. 1. is a perspective view of a portion of an improved wooden sash member according to this invention, showing the lower rail and one stile of the sash member and particularly illustrating the improved two-part glazing system according to this invention.
Figure 7:
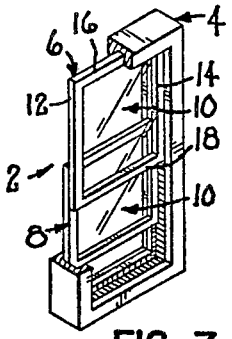
FIG. 7 is a perspective view of a typical double-hung window.

Referring first to FIG. 7, a typical double-hung window is illustrated generally as 2. Window 2 comprises a substantially rectangular window frame 4. Window frame 4 has two vertically extending tracks or channels in which movable upper and lower sash members or sashes 6 and 8 are mounted. Upper and lower sashes 6 and 8 are generally identical and each define a sash frame in which a transparent panel or windowpane 10 is suitably mounted. Windowpane 10 may be made of any suitably transparent material, such as glass, plexiglas, or the like. As shown in FIG. 1, windowpane 10 preferably comprises a double pane insulated type of windowpane having an air space 9 provided between two opposed panes 11a and 11b of glass. Panes 11*a* and 11*b* are welded together at their edges. Window 2 as illustrated herein is of a type known as the Narroline® window manufactured by the Andersen Corporation of Bayport, Minn.

The upper and lower sashes 6 and 8 are generally identical. Each sash has four frame pieces or components arranged to define a substantially rectangular sash frame. These components comprise two vertically extending stiles 12 and 14 which are spaced apart a distance substantially equal to the width of window 2. Stiles 12 and 14 are connected at their upper end by an upper or top rail 16 and at their lower end by a lower or bottom rail 18. The lower rail 18 in the upper sash 6 is customarily known as the upper check rail. Similarly, the top rail 16 of the lower sash 8, which abuts against the lower rail 18 of the upper sash 6 when the two sashes 6 and 8 are closed, is known as the lower check rail. All of the stiles 12 and 14 and rails 16 and 18 are generally identically shaped except as noted hereafter. These components all have a solid (i.e., not hollow) cross-sectional configuration and are made from any suitable materials, such as wood.

Referring now to FIG. 1, a typical lower rail 18 of either lower sash 8 or upper sash 6 is illustrated in an enlarged cross-sectional form. Lower rail 18 has a first substantially vertically extending curved concave surface 20. A second substantially planar surface 22 projects outwardly or forwardly from the first surface 20 and extends at a downward angle from the horizontal. Second surface 22 extends between the first surface 20 and the front edge or side 24 of the lower rail 18. Similarly, a third sloped rearwardly projecting surface 26 leads from the upper edge of the first surface 20 to the rear side 28 of lower rail 18.

Figure 3:
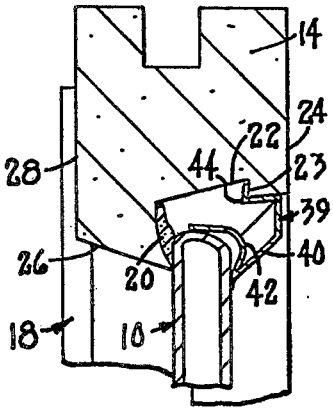
FIG. 3 is a cross-sectional view of the wooden sash member of FIG. 1, taken along lines 3—3 of FIG. 1.
Figure 2:
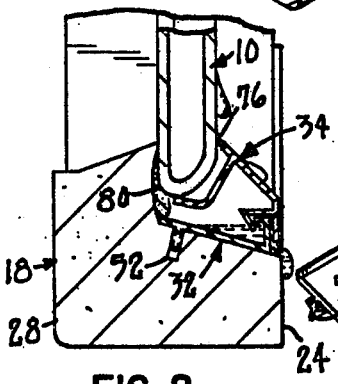
FIG. 2 is a cross-sectional view of the wooden sash member of FIG. 1, taken along lines 2—2 of FIG. 1.

Stiles 12 and 14 and the upper rail 16 on the upper sash 6 have surfaces which are generally similar to those just described for lower rail 18. However, as shown in FIG. 3, the second surface 20 of stiles 12 and 14 and the upper rail 16 on the upper sash 6 is provided with a protruding shoulder 23. Stiles 12 and 14 and rails 16 and 18 are adapted to be fixed together to form the sash frame. When this is done, they all have a first surface (i.e., surface 20) against which the windowpane 10 is fixedly mounted. The second surface (i.e., surface 22) extends outwardly from the first surface along the length of and closely adjacent to one of the corresponding sides of windowpane 10.

The present invention relates in general to a two-part glazing system indicated generally as 30. Glazing system 30 comprises an elongated liner member 32 and a glazing bead 34. Liner member 32 and glazing bead 34 are snap fit together in a manner to be described hereafter. The two-part glazing system 30 is principaly meant for use with the lower rails 18 of both the upper and lower sashes 6 and 8. More particularly, glazing system 30 is used to cover the exterior joints between the lower sides of windowpanes 10 and both lower rails 18.

A conventional glazing system, generally indicated as 38, is preferably used to cover the other joints along the other sides of windowpane 10. In other words, glazing system 38 can be used along the vertical stiles 12 and 14 and along the upper rail 16 of the upper sash. Only one of the joints in either of the upper and lower sashes 6 and 8 is not covered by a glazing system of either the type 30 or 38. The lower check rail, i.e. the upper rail 16 of the lower sash 8, has the windowpane 10 set into a special groove in the rail 16. This groove has a special configuration which includes a plurality of deformable members. A glazing compound is used in this groove to hold the windowpane 10 in place. This type of arrangement is shown more particularly in U.S. Pat. No. 3,555,842, which is assigned to the assignee of the present invention.

Before discussing in detail the improved glazing system 30 of this invention, the operation and structure of glazing system 38, which is generally conventional and has been described previously in the Description of Prior Art, will be further elaborated. Glazing system 38 has previously been used to cover all of the joints of both sash frames 6 and 8 except for that of the lower check rail as described previously. Glazing system 38 includes a vinyl glazing bead 39. Glazing bead 39 has a slanted front panel 40 and a rear panel 42 with a curved half-concaved shape. In addition, front panel 40 includes a rearwardly extending lip 44 thereon. Lip 44 releasably engages the shoulder 23 on the sash frame member in a snap fit.

One problem which occurred when using glazing beads 39 on the lower rails 18 of the sashes 6 and 8 is that water dripping down the face of the windowpane 10 would often be directed between the panel 10 and the curved panel 42. This water would then be directed by rear panel 42 to the interior of the glazing bead 39 beneath and behind front panel 40. This water would then be trapped and left standing on top of the wooden lower rail 18. Such standing water, of course, tended to deteriorate and rot the wooden rail 18.

Glazing system 32 according to this invention substantially solves the above-noted problem recognized by the Applicants. More particularly, liner member 32 is made of a moisture impervious material and has a first planar surface 50 which extends substantially over the entire length and area of the second surface 22 of lower rail 18. The second surface 22 of rail 18 is provided with a longitudinally extending slot or kerf 52. A downwardly projecting locking rib 54 is fixedly attached (e.g., by integral molding) to the underside of the surface 50 of liner member 32. Rib 54 extends along the length of the liner member 32 a distance substantially equal to the length of slot 52. Downwardly projecting rib 54 is substantially rigid and has two resilient or flexible outwardly projecting locking lugs or surfaces 56. Lugs 56 project respectively from either side of rib 54 and run the entire length of the rib.

Figure 4:
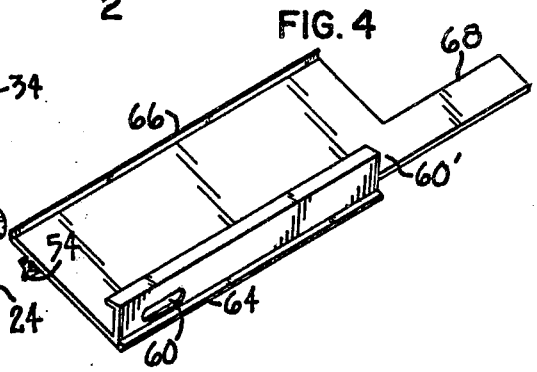
FIG. 4 is a partial perspective view of a portion of the improved two-part glazing system according to this invention, particularly illustrating the construction of the liner member.

Liner member 32 also includes an upwardly extending front wall 58. A substantiall horizontal flange 59 projects rearwardly from the top of wall 58. Front wall 58 has a plurality of outlet drain means comprising drain holes 60 (one of which is shown in FIG. 4). In addition, front wall 58 is also shorter than the length of first surface 50 to leave an additional outlet drain hole or space 60' at either end of front wall 58 in a manner to be described hereafter. The bottom of front wall 58 has a planar flexible sealing gasket 64 which extends the entire length of front wall 58. Similarly, a flexible sealing gasket 66 extends from the rear edge of the planar surface 50 as shown in FIG. 4. An outwardly projecting lateral tab 68 extends from either side of planar surface 50 for a purpose to be described hereafter.

Glazing bead 34 is in some respects similar to glazing bead 39. In other words, glazing bead 34 comprises a slanted front panel 70 terminating in a vertically extending wall 72. A curved, generally half-concaved rear wall or panel 74 is attached to the underside of the front panel 70 and curved down around the windowpane 10 in the manner shown in FIG. 5. However, the entire upper edge of front panel 72 now includes a planar, flexible sealing gasket means 76 which extends the entire length of front panel 70. Furthermore, a V-shaped locking rib 78 extends inwardly from front wall 72. Locking rib 78 and the flange 59 of liner member 32 are adapted to interrelate to one another in a snap fit.

In a preferred manner of making an improved double-hung window 2 according to this invention, the lower rail 18 of each sash is first prepared such that the longitudinally extending slot 52 is cut, machined, or otherwise placed therein. After this is accomplished, liner member 32 is snapped into place in slot 52. In this regard, the flexible locking lugs 56 on rib 54 will resiliently deform and be compressed when the locking rib 54 is inserted into the slot 52. This resilient deformation yieldably and firmly engages the sides of slot 52 to anchor the liner member 32 in place on top of the surface 22 of lower rail 18.

Tabs 68 on lower rail 18 extend out to the very end of the rail 18 over that area of the rail which will subsequently be covered by each of the stiles 12 and 14. After the liner member 32 has been installed on rail 18 in the above-noted manner, the sashes 6 and 8 are then assembled. This operation comprises securing the vertically extending stiles 12 and 14 at their lower ends to the bottom rail 18 and then attaching the top rails 16 to the opposite ends of the stiles. The assembling and securing of these frame members can take any conventional form. For example, a mortise and tenon joint or the like can be used between stiles 12 and 14 and lower rail 18. A suitable glazing tape 80 which comprises a conventional glazing compound is then laid into the glazing area of the sash. The glazing area comprises the first surface 20 on all of the components of the sash, i.e. stiles 12 and 14 and rails 16 and 18. The glazing tape 80 overlies the upper part of gasket 66 to further seal the rear edge of liner member 32. The windowpane 10 is then pressed against the glazing tape 80 to adhesively secure the windowpane 10 in the sash 6 or 8. After this has occurred, the glazing systems 30 or 38 can then be emplaced as noted above against the proper stiles or rails.

With regard to the stiles 12 and 14 and the upper rail 16, the glazing system which is emplaced comprises the glazing beads 39 described earlier which are merely snapped into place along the length of the components. After the beads 39 have been installed, the glazing bead 34 of the two-part glazing system 30 of this invention is then attached by snapping the glazing bead 34 onto the liner member 32. In this regard, the V-shaped locking rib 78 will first be abutted against the front wall 58 and flange 59 of the liner member 32. When an inward force is then applied on the glazing bead 34, the V-shaped locking rib 78 will deform sufficiently to allow the locking rib 78 to engage behind flange 59 in the manner noted in FIG. 5. The glazing bead 34 then extends between the lower portion of the face of windowpane 10 and the liner member 32 to define a substantially enclosed drain tank or chamber 82. Glazing bead 34 will also have the flexible sealing gasket 76 in firm engagement with the face of windowpane 10. When assembled in the above-noted manner, the front wall or panel 72 of the glazing bead 34 is spaced from and in front of the front wall 58 of the liner member 32. Thus, front wall 72 covers or hides but does not obstruct drain holes 60.

Figure 5:
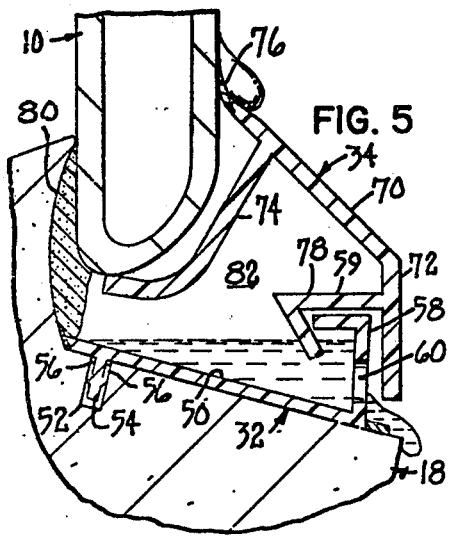
FIG. 5 is a enlarged cross-sectional view of the improved two-part glazing system according to this invention, the FIG. 5 view being generally similar to the view shown in FIG. 2.
Figure 6:
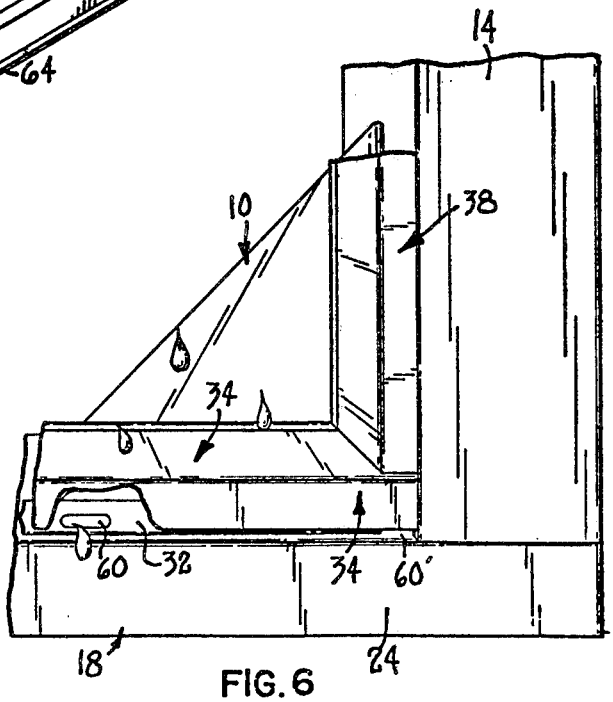
FIG. 6 is a partial front view of an improved wooden sash member according to this invention, illustrating in particular the improved two-part glazing system of FIG. 1 with a portion thereof broken away for clarity.

Referring now to FIGS. 5 and 6, water from a rain or snow storm or the like will generally fall down the face of windowpane 10. This water will first engage the flexible gasket 76 located on the glazing bead 34. This gasket 76 serves to seal the windowpane 10 and deflect most of the water proceeding down the face of the pane outwardly over glazing bead 34 and away from the drain tank 82. However, some water will find its way into the drain tanks 82 through any nonuniformities possibly present in the gasket 76 or perhaps along the miter joints at either end of the glazing system 32 where the glazing bead 34 is matched with the glazing bead 39.

In the case where water gets past gasket 76, such water will travel down and be deflected by the curved rear panel 74 of bead 34 on top of the moisture impervious liner member 32. Since this liner member 32 has planar surface 50 slanted downwardly, the water will fall by gravity down the surface 50 and will be directed out through the outlet drain holes 60 to a position outside the sash frame. In this regard, the space between the front wall 72 of glazing bead 34 and front wall 58 of liner member 32 ensures that water can freely pass through the drain holes 60 outwardly from the window sash 6 or 8. However, the front wall 72 is sufficiently long to cover or hide all of the drain holes 60 to decoratively enhance the appearance of glazing system 30. Furthermore, because the front wall 58 does not extend the entire length of the planar surface 50, the additional drain holes 60' are provided at either end of the front wall 58 between the front wall 58 and the adjacent stile 12 or 14. This decrease in the length of front wall 58 also makes the initial positioning of liner member 32 on surface 22 less critical since some leeway is available at either side thereof vis a vis the subsequent location of stiles 12 and 14.

Glazing system 30 according to the present invention is particularly advantageous in preventing water from collecting or standing on the planar surface 22. Applicants have constructed a number of double-hung window units 2 to incorporate the two-part glazing system 30 on the lower rails 18 thereof. These units were then tested for water drainage. A red powdered dye was applied to the liner members 32 after which the glazing bead 34 was snapped into place on liner member 32. The window units were then placed in an upright position and water was squirted on the face of windowpane 10 by means of a rubber hose. Red dye first appeared through the drain holes 60' near the corners. In less than one minute all the drain holes 60 were draining freely. After shutting off the water, the beads 34 were then removed and there was no visible or apparent sign of standing or trapped water on top of liner member 32. The ability of glazing system 30 to prevent or eliminate the problem of standing water on the lower rails 18 of double-hung window 2 means that such rails will be less subject to deterioration. This ensures that double-hung window units 2 will have a longer life, require less maintenance, and thus be more desirable to the consumer.

Glazing bead 34 and liner member 32 are preferably made of a relatively rigid polyvinylchloride (PVC) material or any other suitably rigid materials. The flexible portions of these components (i.e., locking lugs 56, gaskets 64, 66 and 76) can be made of a resilient PVC material or other resilient compositions.

Various other modifications of this invention will be apparent to those skilled in the art. Thus, the scope of this invention is to be limited only by the appended claims.

What is claimed is:

1. An improved window sash of the type having two spaced substantially vertical stiles connected together at one end by a substantially horizontal upper rail and at the other end by a substantially horizontal lower rail, each of the stiles and rails having a generally solid cross-sectional configuration which includes a first surface against which a windowpane is mounted and a second surface projecting outwardly from the first surface, the second surface of each of the stiles and rails extending along and adjacent to one of the sides of the windowpane, and wherein the improvement relates to a two-part glazing system for at least the lower rail of the window sash, which glazing system comprises the combination of:

(a) an elongated moisture impervious liner member secured to the second surface of the lower rail wherein the liner member extends along substantially the entire length of the adjacent side of the windowpane and is spaced therefrom, and wherein the liner member has outlet port means for draining away to the exterior of the window sash any moisture which collects on top of the liner member; and (b) an elongated glazing bead operatively associated with the liner member, the glazing bead extending between the liner member and an exterior face of the windowpane along the adjacent side thereof, the glazing bead having gasket means for sealing the glazing bead against the exterior windowpane face to define an enclosed drain tank, whereby the gasket means prevents a substantial amount of moisture on the exterior windowpane face from reaching the drain tank and the outlet port means of the liner member drains away any moisture present in the drain tank to lessen deterioration of the lower rail.

2. An improved window sash as recited in claim 1, in which both the liner member and the glazing bead are formed of a rigid plastic material, and wherein the gasket means for the glazing bead is made of a flexible plastic sealing material.

3. An improved window sash as recited in claim 1, wherein the liner member has a configuration which is suitable for being snap fit onto the second surface.

4. An improved window sash as recited in claim 3, in which the second surface of the lower rail has a longitudinal upwardly extending slot therein, and wherein the liner member has a planar liner surface which is superimposed over substantially the entire area of the second surface of the rail, the liner surface of the liner member having a downwardly extending rib projecting therefrom which extends into the slot in the second surface, and wherein the rib has a plurality of flexible locking lugs which resiliently engage the sides of the slot to couple the liner member thereto in a snap fit.

5. An improved window sash as recited in claim 4, in which the liner member and the glazing bead are operatively associated together by a snap fit.

6. An improved window sash as recited in claim 1, wherein the liner member and the glazing bead are operatively associated together by a snap fit.

7. An inproved window sash as recited in claim 6, wherein the liner member has an upwardly extending front wall having a substantially horizontal and rearwardly extending flange, wherein the glazing bead includes a downwardly depending vertical wall which has a V-shaped, rearwardly extending locking flange thereon, and wherein the locking flange interlocks with the horizontal flange of the liner member to couple the glazing bead to the liner member in the snap fit.

8. An improved window sash as recited in claim 7, wherein the vertical wall of the glazing bead is spaced in front of the front wall of the liner member to cover but not obstruct the outlet port means thereof.

9. An improved window sash as recited in claim 7, in which the outlet port means comprise a plurality of holes spaced along the vertically extending front wall of the liner member.

10. An improved double-hung window of the type having movable upper and lower sashes, each sash having two spaced substantially vertical stiles connected together at one end by a substantially horizontal upper rail and at the other end by a substantially horizontal lower rail, each of the stiles and rails having a first surface against which a windowpane is mounted and a second surface projecting outwardly from the first surface, the second surface of each of the stiles and rails extending along and adjacent to the one of the sides of the windowpane, and wherein the improvement relates to a two-part glazing system for at least the lower rails of both the upper and lower sashes, which glazing systems comprises the combination of:

(a) an elongated moisture impervious liner member secured to the second surface of the lower rail, wherein the liner member extends along substantially the entire length of the adjacent side of the windowpane and is spaced therefrom, and wherein the liner member has outlet port means for draining away to the exterior of the window sash any moisture which collects on top of the liner member; and (b) an elongated glazing bead operatively associated with the liner member, the glazing bead extending between the liner member and an exterior face of the windowpane along the adjacent side thereof, the glazing bead having gasket means for sealing the glazing bead against the exterior windowpane face to define an enclosed drain tank, whereby the gasket means prevents a substantial amount of moisture on the exterior windowpane face from reaching the drain tank and the outlet port means of the liner member drains away any moisture present in the drain tank to lessen deterioration of the lower rail.

11. An improved window sash as recited in claim 10, wherein the liner member and the glasing bead are operatively associated together by a snap fit, and wherein the liner member has a configuration which is suitable for being snap fit onto the second surface of the lower rail.

* * * * *

UNITED STATES PATENT AND TRADEMARK OFFICE

CERTIFICATE OF CORRECTION

PATENT NO. : 4,154,033

DATED : May 15, 1979

INVENTOR(S) : Neil Krueger, Donald L. Garofalo, and John O. Kohl

It is certified that error appears in the above-identified patent and that said Letters Patent are hereby corrected as shown below:

In column 4, line 27, for "all" read --all--.
line 64, for "substantiall" read --substantially--.

In column 8, line 62, for "glasing" read --glazing--.

Signed and Sealed this

*Eleventh* Day of *September 1979*

[SEAL]

*Attest:*

*Attesting Officer*

LUTRELLE F. PARKER

*Acting Commissioner of Patents and Trademarks*